United States Patent [19]

Iwata

[11] Patent Number: 4,762,110

[45] Date of Patent: Aug. 9, 1988

[54] IGNITION CONTROL DEVICE FOR INTERNAL COMBUSTION ENGINE

[75] Inventor: Toshio Iwata, Himeji, Japan

[73] Assignee: Mitsubishi Denki Kabushiki Kaisha, Tokyo, Japan

[21] Appl. No.: 946,215

[22] Filed: Dec. 24, 1986

[30] Foreign Application Priority Data

| | | | |
|---|---|---|---|
| Jan. 21, 1986 | [JP] | Japan | 61-12329 |
| Jan. 22, 1986 | [JP] | Japan | 61-13080 |
| Jan. 30, 1986 | [JP] | Japan | 61-20624 |

[51] Int. Cl.[4] ..... F02P 1/00

[52] U.S. Cl. ..... 123/609; 123/611

[58] Field of Search ..... 123/609, 611

[56] References Cited

U.S. PATENT DOCUMENTS

| | | | |
|---|---|---|---|
| 4,253,443 | 3/1981 | Seeger | 123/611 |
| 4,267,813 | 5/1981 | Hohne | 123/609 |
| 4,351,287 | 9/1982 | Shirasaki | 123/611 |
| 4,378,778 | 4/1983 | Harter | 123/609 |
| 4,627,398 | 12/1986 | Koike | 123/609 |
| 4,665,884 | 5/1987 | Yoshida | 123/609 |

*Primary Examiner*—Ronald B. Cox

*Attorney, Agent, or Firm*—Sughrue, Mion, Zinn, Macpeak and Seas

[57] ABSTRACT

The present invention utilizes, selectively, a first signal formed in a first section of an ignition period composed of the first section and a second section with a predetermined ratio or a second signal formed in the second section according to a ratio of a time in which a current is supplied to an ignition coil to the ignition time period to obtain a start time of current supply to the coil means.

8 Claims, 6 Drawing Sheets

IGNITION CONTROL DEVICE FOR INTERNAL COMBUSTION ENGINE

BACKGROUND OF THE INVENTION

This invention relates to an ignition control device for an internal combustion engine, and particularly, to an improved device for controlling the time period in which an electric current is supplied to an ignition coil.

An induction discharge type ignition device for use in an internal combustion engine is well known, in which high voltage energy is produced in the secondary side of an ignition coil by cutting off the electric current flowing through the primary winding of the coil so that a spark discharge is produced in an ignition plug connected to the secondary winding of the coil.

In general, the high voltage energy mentioned above depends upon the current value of the current flowing through the primary winding of the ignition coil at the time when it is cut off. (The current value will be referred hereinafter as cut-off current.)

Therefore, in order to obtain enough energy to ignite the internal combustion engine, it is necessary to supply an electric current to the primary winding of the ignition coil until the cut-off current becomes enough to ignite. A time from a start of current supply to the primary winding to a time at which the cut-off current reaches a value large enough to ignite, i.e., a current supply time, is determined by the battery voltage, the inductance on the primary side of the ignition coil, and the resistance on the primary side of the coil, etc. Further, the ratio of the current supply time to the ignition period, referred to as a circuit closing ratio hereinafter, depends upon the number of revolutions of the engine. Therefore, the current supply time should be controlled such that a desired cut-off current value is obtained by taking these variables into consideration.

U.S. Pat. No. 4,041,912 and Japanese Kokai No. 40412/1978 disclose control devices capable of controlling the current supply time, respectively. Among others, the device disclosed in the latter controls the current supply time such that the ratio of a time period for which a current in the primary winding of the ignition coil is maintained at a predetermined value to the engine ignition period becomes constant.

However, since, in such conventional device, a calculation of a current supply timing is performed uniformly for every ignition period, a current supply time long enough to ignite cannot be obtained if the ignition period is reduced abruptly due to a high acceleration of the engine or due to large lead angle of ignition timing, in a case where the circuit closing ratio required for a low revolution speed of the engine is small, resulting in a misfiring of the engine.

SUMMARY OF THE INVENTION

A primary object of the present invention is to provide an ignition control device for an internal combustion engine, which improves a transient response of control of the current supply time to thereby prevent a misfire of an engine from occurring.

Another object of the present invention is to provide an ignition control device capable of assuring a current supply time at least long enough to ignite an ignition plug even when the ignition period becomes abruptly shortened.

A further object of the present invention is to provide an ignition control device capable of cutting-off an unnecessary current supply when the ignition period becomes extremely longer.

In order to achieve these objects, the ignition control device for the internal combustion engine according to the present invention comprises means for providing a signal indicative of a time point in an ignition period between an ignition time and a subsequent ignition time, means for producing a first signal during a time from the ignition time to the time point and a second signal during a time from the time point to the subsequent ignition time, and means responsive to either of the first or second signal for calculating and providing a current supply signal for the ignition coil.

DETAILED DESCRIPTION OF THE PREFERRED EMBODIMENTS

Figure 1:
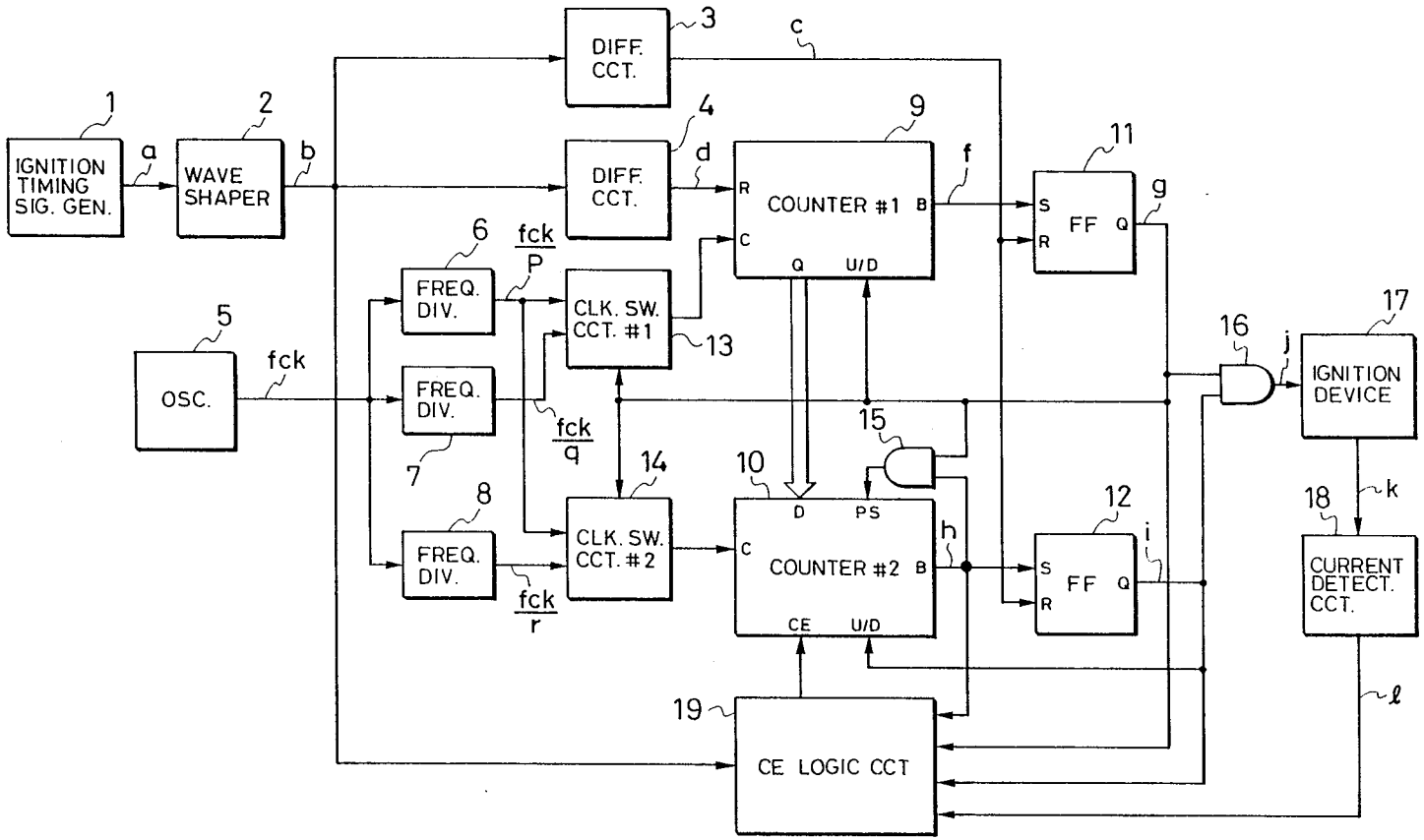
FIG. 1 is a block circuit diagram showing an ignition control device for an internal combustion engine of an embodiment of the present invention.

An embodiment of the present invention will be described with reference to FIG. 1, in which a reference numeral 1 depicts an ignition timing signal generator for generating a signal synchronous with an ignition timing of an engine and may be a signal generator housed in a distributor which is not shown. A waveshaper 2 is connected to the ignition timing signal generator 1, which functions to shape an output signal of the ignition timing signal generator 1 to a rectangular wave. Differentiators 3 and 4 have input terminals connected to an output terminal of the waveshaper 2. The differentiator 3 functions to provide a pulse signal at a trailing edge of the rectangular output wave of the waveshaper 2, which corresponds to the ignition timing, and the differentiator 4 provides a pulse signal at a leading edge of the output signal of the waveshaper 2. An oscillator 5 produces clock pulses at a frequency $f_{CK}$ which is divided by frequency dividers 6 to 8 by 1/p, 1/q and 1/r, respectively. A reference numeral 9 depicts a first up/down counter which has a reset input terminal (R terminal), a clock input terminal (C terminal), an up/down switching input terminal (U/D terminal), an output terminal (Q terminal) for providing a counting content, and an output terminal (B terminal) for providing a borrow signal indicative of a zero content in a down counting mode of operation thereof.

The control device shown in FIG. 1 further comprises a second up/down counter 10 which has a clock terminal (C terminal), a count enable terminal (CE terminal) for determining whether or not a counting is possible, an up/down switching terminal (U/D terminal), a data input terminal (D terminal), a preset terminal (PS terminal) for pre-setting a value to be inputted to the D terminal and an output terminal (B terminal)

for providing a borrow signal. The D terminal is connected to the Q terminal of the first counter 9.

Each of flip-flops (FF) 11 and 12 has a set terminal (S terminal), a rest terminal (R terminal) and an output terminal (Q terminal). The S terminal of the flip-flop 11 is connected to the B terminal of the first counter 9 and the R terminal is connected to the output terminal of the differentiator 3. The S terminal of the FF 12 is connected to the B terminal of the second counter 10 and the R terminal thereof is connected to the output of the differentiator 3. A reference numeral 13 depicts a first clock switching circuit which has three input terminals connected to an output terminal of the frequency divider 6, an output terminal of the frequency divider 7 and the Q terminal of the FF 11, respectively, and an output terminal connected to the C terminal of the first counter 9. The first clock switching circuit 13 functions to select clock pulses from either the frequency dividers 6 and 7 to be supplied to the first counter 9 such that, when the output of the FF 11 is "H", it provides the output signal frequency $f_{CK}/p$ of the frequency divider 6 to the first counter 9 and provides the clock pulse signal $f_{CK}/q$ from the frequency divider 7 when the output of the FF 11 is "L". A second clock switching circuit 14 has three input terminals connected similarly to the outputs of the frequency dividers 6 and 8 and the Q terminal of the FF 11, respectively, and an output terminal connected to the C terminal of the second counter 10 and selects one of the output frequencies of the frequency dividers 6 and 8 according to the output signal of the FF 11 to supply it to the second counter 10, such that, when the output of the FF 11 is "H", it selects the output pulse frequency $f_{CK}/p$ of the frequency divider 6 and the output pulse frequency $f_{CK}/r$ of the frequency divider 8 when it is "L".

An input of an AND gate 15 is connected to the Q terminal of the FF 11 and the B terminal of the second counter 10, and an output thereof is connected to the PS terminal of the same counter. An AND gate 16 has inputs connected to the Q terminals of the FFs 11 and 12 and an output connected to an ignition device 17.

The ignition device 17 includes a switching circuit functioning to supply a current to the primary side of the ignition coil when the output signal of the AND gate 16 becomes "H" and thereafter to cut-off the current when the ignition signal from the AND gate 16 is turned to "L".

A current detection circuit 18 provides a signal so long as the current flowing in the primary side of the ignition coil is at or above a predetermined value. A count enable logic circuit (CE logic circuit) 19 has a plurality of inputs connected to the output terminal of the waveshaper 2, the B terminal of the second counter 10, the Q terminal of the FF 11, the Q terminal of the FF 12 and an output of the current detection circuit 18, respectively, and an output connected to the CE terminal of the second counter 10. The CE logic circuit 19 comprises a set of logic circuits capable of performing a logic operation to be described later.

Figure 2:
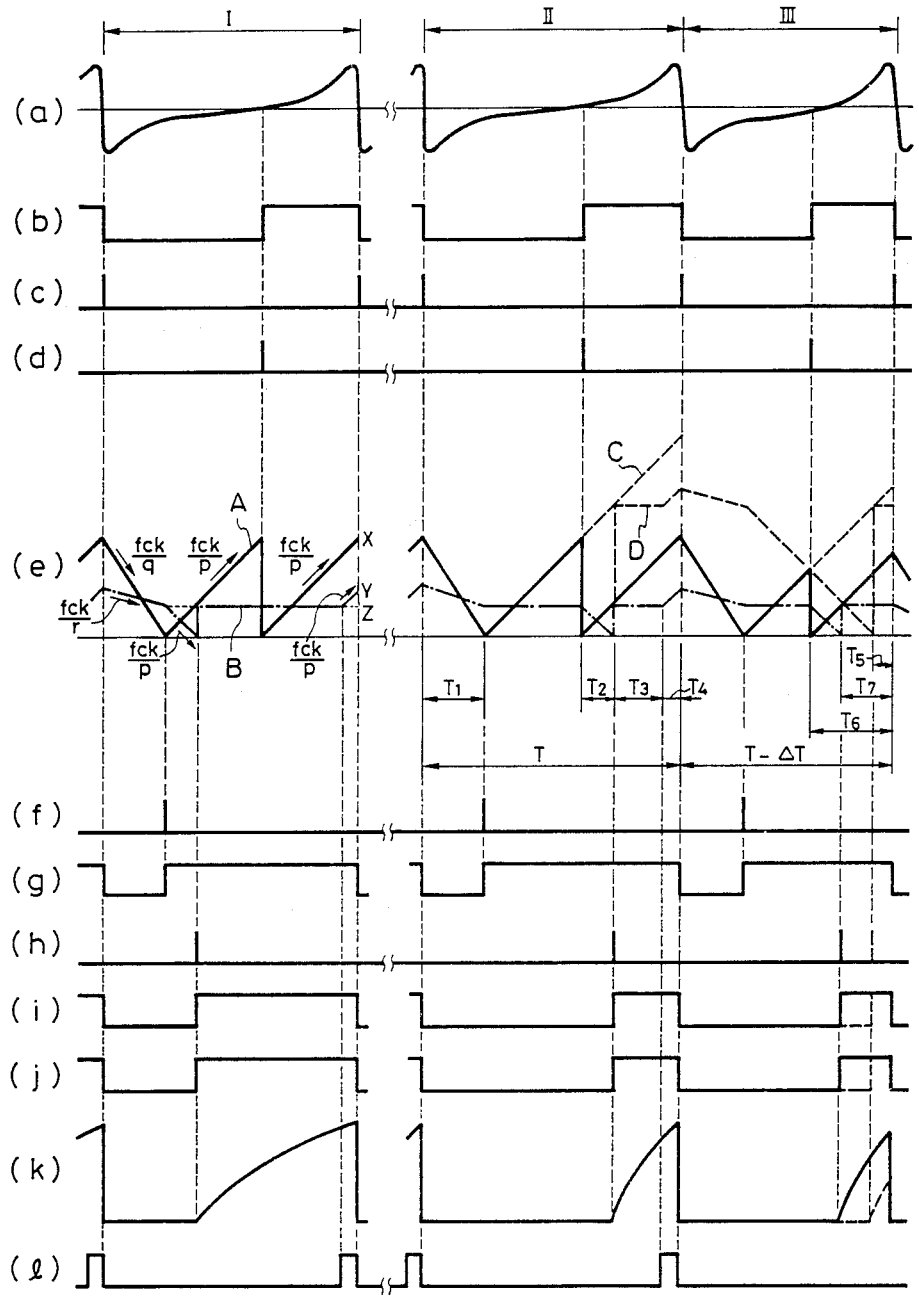
FIG. 2 shows waveforms for explanation of operation of various portions of the control device shown in FIG. 1.

Describing the operation of the device mentioned hereinbefore with reference to FIG. 2, in which a waveform a is an output signal of the ignition timing generator 1, a waveform b is a rectangular signal obtained by shaping the waveform a by using the waveshaper 2 and having a trailing edge corresponding the ignition timing, waveforms c and d are output signals of the differential circuits 3 and 4, respectively, a waveform e shows contents of the first and second counters 9 and 10 in which a solid portion A shows that of the first counter 9 and a chained portion B shows that of the second counter 10, a waveform f is an output signal (borrow signal) at the B terminal of the first counter 9, a waveform g is an output signal at the Q terminal of the FF 11, a waveform h is a borrow signal of the second counter 10, a waveform i is an output signal at the Q terminal of the FF 12, a waveform j is an output signal (ignition signal) of the AND gate 16, a waveform k is a primary current of the ignition coil and a waveform l is an output signal of the current detection circuit 18, the FF 11 is reset at an ignition time corresponding to the trailing edge of the rectangular pulse on the waveform b by the output pulse c of the differentiator circuit 3 and thus the Q terminal thereof becomes "L" as shown by the waveform g. Therefore, the first counter 9 becomes in the down count mode and the first clock switching circuit 13 provides at the output thereof the clock pulse $f_{CK}/q$ from the frequency divider 7. As a result, the first counter 9 down-counts at $f_{CK}/q$ from the ignition time as shown by the waveform e. When the content of the first counter 9 becomes zero, a borrow signal appears at the B terminal thereof as shown by the waveform f causing the output at the Q terminal of the FF 11 to be inverted from "L" to "H" as shown by the waveform g. Consequently, the first counter 9 becomes the up-count mode and the first clock switching circuit 13 provides at its output the output of the frequency divider 6, $f_{CK}/p$.

As a result, the first counter 9 produces a first signal which is an up-counting at $f_{CK}/p$ as shown by the waveform e.

Then, when the pulse shown by the waveform d is provided by the differentiator 4 at the leading edge of the rectangular wave b, the first counter 9 is reset thereby and, then, up-counts the clock pulse $f_{CK}/p$ until a next ignition time to provide a second signal at the Q terminal. Therefore, the content of the first counter 9 repeats up and down in synchronism with the rectangular wave b as shown by the solid line A of the waveform e.

Table 1 below shows a logic operation of the CE logic circuit 19. In Table 1, output signal modes of the CE logic circuit with respect to various modes of inputs thereto are classified into modes A to F according to the truth table. "H" in a count enable output mode represents that a count is possible and "L" represents that a count is impossible.

TABLE 1

| | Input | | | | | |
|---|---|---|---|---|---|---|
| Mode | waveshaper output signal | FF 12 output signal | FF 11 output signal | current detection signal | Δ | Count enable output |
| A | * | * | L | * | * | H |
| B | * | * | * | H | * | H |
| C | * | H | H | L | * | L |
| D | L | * | H | L | YES | L |
| E | * | L | * | * | NO | H |
| F | H | L | * | * | YES | H |

*: disregarded
Δ: Is the borrow signal of the second counter 10 in a preceding ignition period fallen with a "H" period of the output signal of the waveshaper 2?

At the ignition time corresponding to the trailing edge of the rectangular wave b, the FF 12 is reset by the output pulse c of the differentiator 3 and thus the Q terminal thereof becomes "L" as shown by the waveform i. Therefore, the second counter 10 is shifted to the down count mode.

On the other hand, the second clock switching circuit 14 provides the clock pulse $f_{CK}/r$ of the frequency divider 8 in an "L" output period of the FF 11, i.e., an L region of the waveform g. In this case, since the input signal condition corresponds to the A mode in Table 1, the CE logic circuit 19 provides a "H" signal. Therefore, the second counter 10 is down counted at the clock pulse $f_{CK}/r$ in the "L" region shown by the waveform g. Then, when the output of the FF 11 is inverted from "L" to "H", the output of the second clock switching circuit 14 is switched to clock pulse $f_{CK}/p$ which is the output of the frequency divider 6.

When the time at which the borrow signal is provided by the second counter 10 in the preceding ignition period is fallen in the "L" region of the rectangular wave b, the CE logic circuit 19 provides a "H" signal since the input signal condition corresponds to the E mode in Table 1. Therefore, the second counter 10 down counts with the clock pulse $f_{CK}/p$ as shown by the chain line portion B of the waveform e in a period I in FIG. 2. When the second counter 10 counts down to zero, it provides, at its B terminal, a borrow signal shown by the waveform h. The borrow signal is supplied through the AND gate 15 to the PS terminal of the counter 10 to preset the content of the first counter 9 in the second counter 10. The output of the FF 12 is switched by this borrow signal from "L" to "H" as shown by the waveform i, so that the second counter 10 is switched to the up-count mode. At this time, the output of the AND gate 16 is switched from "L" to "H" as shown by the waveform j and the ignition device 17 supplies a current to the ignition coil. Then, at the ignition time, the output of the AND gate 16 is turned to "L" upon which the primary current of the ignition coil is cut-off to ignite the engine.

The current detection circuit 18 provides a current detection signal shown by the waveform l in FIG. 2 continuously so long as the primary current of the ignition coil is at or above the predetermined level, and the current detection signal is supplied to the CE logic circuit 19. In the period in which the output of the FF 12 is "H", i.e., the "H" region of the waveform i in FIG. 2., the CE logic circuit 19 provides an "L" signal in a region where there is no current detection signal, since the input condition corresponds to the C mode in Table 1. On the other hand, it provides a "H" signal in a region where there is the current detection signal since the input signal condition corresponds to the B mode in Table 1. Therefore, in the "H" output region of the FF 12, i.e., the current supply region of the ignition coil, the second counter 10 does not count, when there is no current detection signal as shown by the waveform e, to hold the preset count content mentioned previously and up-counts with the clock pulse $f_{CK}/p$ when there is the current detection signal. Thus, the count content of the second counter 10 moves up and down as shown by the chain line in the waveform e in the period I in FIG. 2.

An operation of the ignition control device of this invention, in a case where the output timing of the borrow signal of the second counter 10 is fallen within the "H" period of the rectangular wave b, will be described with reference to waveforms shown in a period II in FIG. 2. The second counter 10 counts down with the clock pulse $f_{CK}/r$ when the FF 11 is in "L" level as in the same manner as mentioned previously. When the output of the FF 11 is turned to "H", the CE logic circuit 19 provides an "L" signal since the input signal condition corresponds to the D mode in Table 1. Therefore, the second counter 10 does not perform the counting operation as shown by the chain line e in the period II and, thus, holds the count content at the switching time of the output of the FF 11 from "L" to "H".

When the output signal b of the waveshaper 2 becomes "H", the CE logic circuit 19 provides a "H" signal since the input signal condition corresponds to the F mode. Therefore, the second counter 10 counts down with the clock pulse $f_{CK}/p$. The operation of the control device after the count content of the second counter 10 becomes zero is the same as that mentioned previously.

In this embodiment, the control of the start time of current supply to the ignition coil is performed separately for the case where the circuit closing ratio is large and the current supply start time corresponding to the provision of the borrow signal of the second counter 10 is fallen in the "L" region of the output signal b of the waveshaper 2 as in the period I, and for the case where the circuit closing ratio is small and the current supply start time is fallen in the "H" region of the output signal of the waveshaper 2 as in the period II.

A control of the current supply time for the ignition coil will be described.

As shown in the period I in FIG. 2, when the ignition period T, the battery voltage and the ignition coil etc. are fixed, a time $T_3$ within which the primary current of the ignition coil reaches the predetermined level is constant and the count content X of the first counter 9 and the contents Y and Z of the second counter 10 are constant, respectively. Assuming that a ratio of a "H" period of the rectangular output wave b of the waveshaper 2 to the ignition period is $\alpha\%$, a ratio of the "L" period of the output of the FF 11 to the ignition period, $\beta\%$, can be represented by $$\beta=(q/p)\cdot\alpha$$

and the following equations are established.

$$Y=Z+(f_{CK}/r)\cdot T_1 \quad (T_1\text{: "L" period of the FF 11 output})$$

$$Y=Z+(f_{CK}/p)\cdot T_4 \quad (T_4\text{: current detection signal period})$$

$$T_1=(\beta/100)\cdot T$$

From the latter three equations, $$T_4=(q/r)\cdot(\alpha/100)\cdot T$$

is obtained.

Therefore, it is clear that the ratio of the time $T_4$ during which the current detection signal is in the "H" level to the ignition period T is $(q/r)\cdot\alpha\%$, constant. This is also true for the period II in FIG. 2. Thus, it is possible to control the period in which the primary current of the ignition coil is at or above the predetermined level to a predetermined ratio to the ignition period.

As to the control of the current supply time in a case where the ignition period T, the battery voltage and the ignition coil etc. are changed, it can be done in the same manner as that disclosed in the previously mentioned Japanese Kokai No. 40141/1978 and therefore, details thereof is omitted for avoidance of duplication.

The dotted line portion of the waveform e in the period II in FIG. 2 shows an operation of the conventional control device in a case where the circuit closing ratio is small and is changed abruptly in a direction in which the ignition period is shortened, in which a portion C relates to the operation of the first counter 9, and a portion D relates to that of the second counter 10. Particularly, the operation C shows that the counter is not reset at the leading edge of the output signal of the waveshaper 2 and continues to count. In the case where the ignition period is stationary as in the period II in FIG. 2, the conventional control device controls the timing of the power supply such that the ratio of the current detection signal period to the ignition period is fixed to a predetermined value, as in this embodiment of the present invention. However, when the ignition period is changed abruptly from T to $T-\Delta T$ as shown in the period III, locuses of the portions C and D showing conventional operations of the current supply time are changed to those shown by dotted lines in a period III in FIG. 2. Thus, the current supply time $T_5$ in the case of the conventional control device becomes as follows:

$$T_5 = T_3 + T_4 - (T - \Delta T))$$

$$= T_3 + T_4 - \Delta T$$

Thus, the current supply time is reduced by a difference of the ignition period. As a result, the primary current waveform of the ignition coil becomes as shown by a dotted line in the waveform k in the period III. That is, the current cannot reach the cut-off current value required by the engine, resulting in a misfiring.

On the contrary, in this embodiment, the first and second counters 9 and 10 operate as shown by solid and chained lines of the waveform e in the period III, respectively. A time width $t_6$ of the "H" period of the rectangular wave b from the waveshaper 2 becomes:

$$T_6 = (\alpha/100) \cdot (i\ T - \Delta T)$$

and the current supply time $T_7$ for the ignition coil becomes as follows:

$$\begin{aligned} T_7 &= T_6 - T_2 \\ &= (\alpha/100) \cdot (T - \Delta T) - ((\alpha/100) \cdot T - (T_3 + T_4)) \\ &= T_3 + T_4 - (\alpha/100) \cdot \Delta T \end{aligned}$$

Since, in the above equation, $\alpha < 100\%$, a relation of the current supply time $T_5$ of the conventional control device to that $T_7$ of the present embodiment is $T_7 > T_5$. Therefore, the degree of reduction of the current supply time of the present embodiment is much smaller than that of the conventional control device. As a result, the primary current of the ignition coil becomes as shown by the solid line portion of the waveform k in the period III in FIG. 2 and thus it becomes possible to obtain a cut-off current of the ignition coil which is much larger than that obtained by the conventional device.

Another embodiment of the present invention will be described with reference to FIGS. 3 and 4 in which same components as those in the first embodiment are depicted by same reference numerals, respectively.

Figure 3:
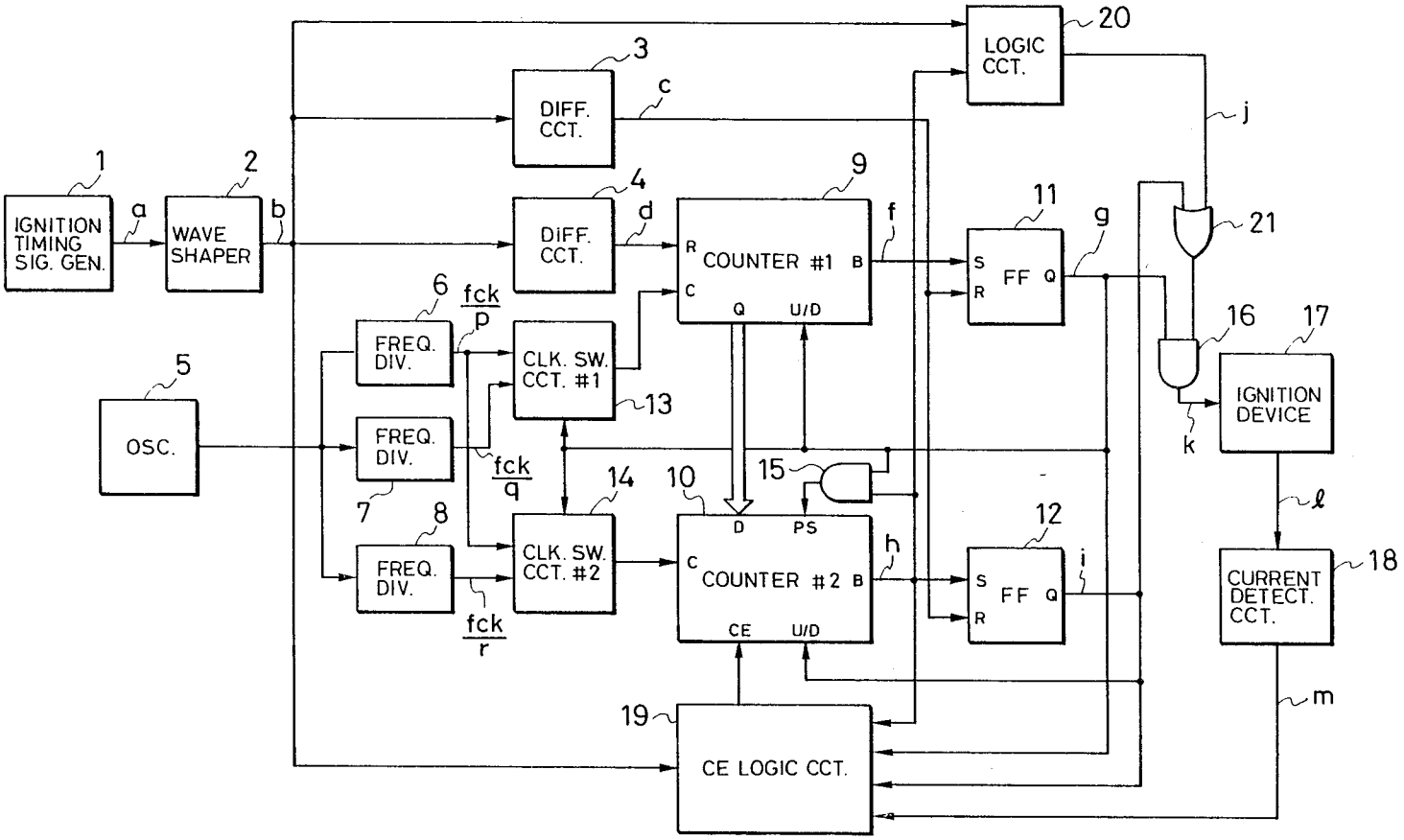
FIG. 3 is a block circuit diagram of another embodiment of the present invention.

In FIG. 3 showing the second embodiment in block form, the output of the waveshaper 2 is supplied to a first input terminal of a logic circuit 20 having a second input terminal supplied with an output of the second counter 10. The logic circuit 20 performs a logic operation shown in Table 2 below and an output thereof is supplied to a second input terminal of a 2-input OR gate 21.

TABLE 2

| Mode | Input Condition Is a borrow signal of the second counter 10 in a preceding ignition period fallen in a "L" period of an output of the waveshaper 2? | Output signal |
|---|---|---|
| G | YES | output signal of waveshaper 2 |
| H | NO | L |

The first input terminal of the OR gate 21 is connected to the output terminal Q of FF 12 and an output thereof is connected to a second input terminal of AND gate 16.

Figure 4:
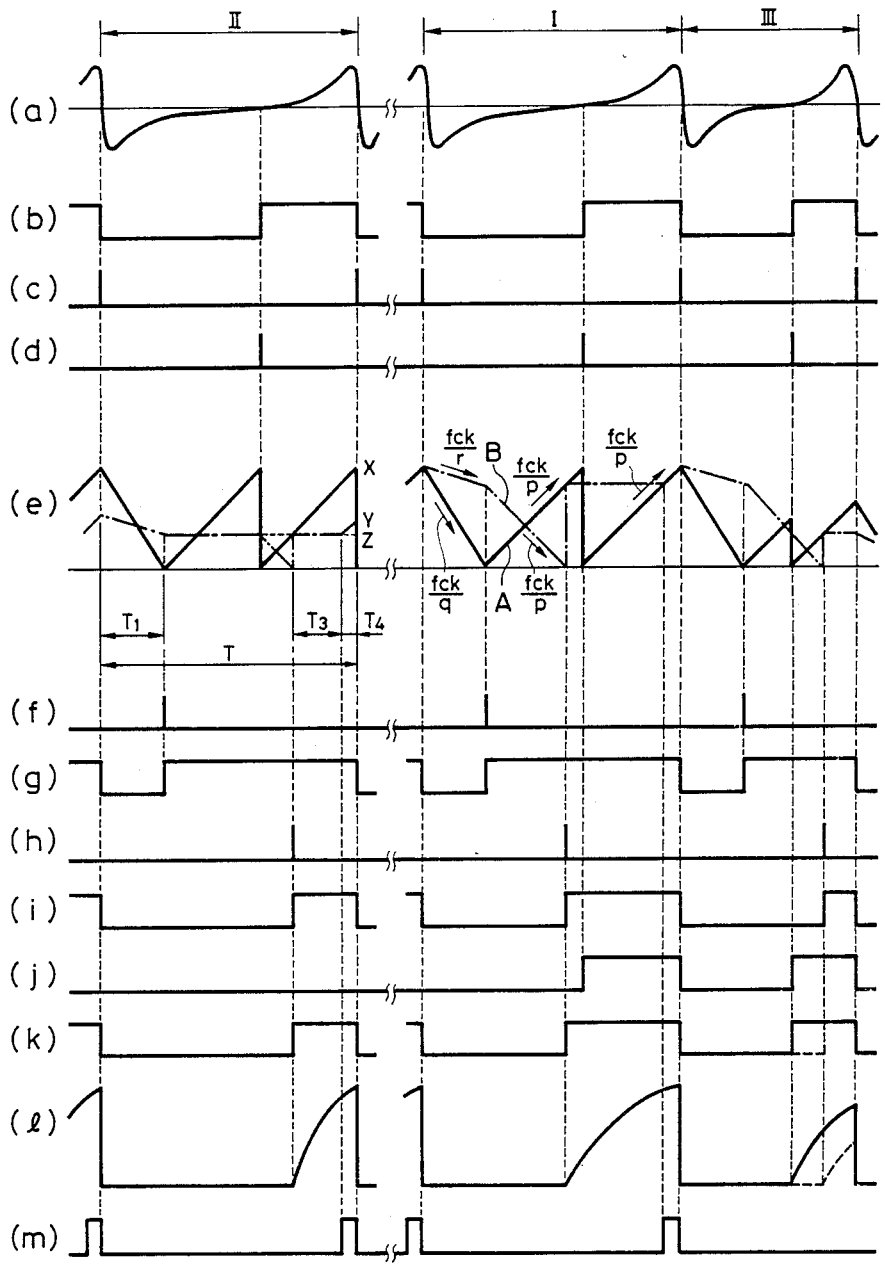
FIG. 4 shows waveforms for explanation of operations of various portion of the control device shown in FIG. 3.

When the engine is accelerated at high rate or the ignition timing is changed in the lead angle side abruptly, the ignition period becomes shortened abruptly as shown in a period III in FIG. 4. In a case where the current supply start time is within a "H" period of the output signal b of the waveshaper 2 in FIG. 4, an operation of the current supply time is commenced at a leading edge of the rectangular signal b. Therefore, since the leading edge of the rectangular signal follows the shortened ignition period, a favorable response to such abrupt shortening of the ignition period can be obtained.

In a case where the ignition current supply start time is within a "L" period of the rectangular signal b, however, the operation of the current supply time is started at a leading edge of an output signal g of the FF 11 as shown in FIG. 4. Therefore, it cannot follow the reduction of the ignition period, resulting in a degraded response comparing with the former case.

Particularly, as shown in a period I in FIG. 4, the closer the current supply start time to the leading edge of the rectangular signal b is the larger the reduction rate of the current supply time, causing the cut-off current of the ignition coil to be reduced considerably as shown by a dotted line portion of a waveform I in the period III.

According to the present invention, however, when the borrow signal from the second counter 10 in the preceding ignition period, the borrow signal being indicative of the current supply start time, is within the "L" period of the output signal b of the waveshaper 2, the input condition of the logic circuit 15 becomes the G mode to provide the output signal b. Therefore, an output of an AND gate 18 becomes as shown by a solid line portion of a waveform k in the period III to thereby retain a predetermined current supply time. As a result, the cut-off current of the ignition coil becomes as shown by a solid line portion of the waveform l in the period III in FIG. 4 which does not decrease at high rate.

Thus, the logic circuit 15 sets the circuit closing ratio to a minimum required value when it is larger than that of the "H" period of the rectangular waveform b.

Figure 5:
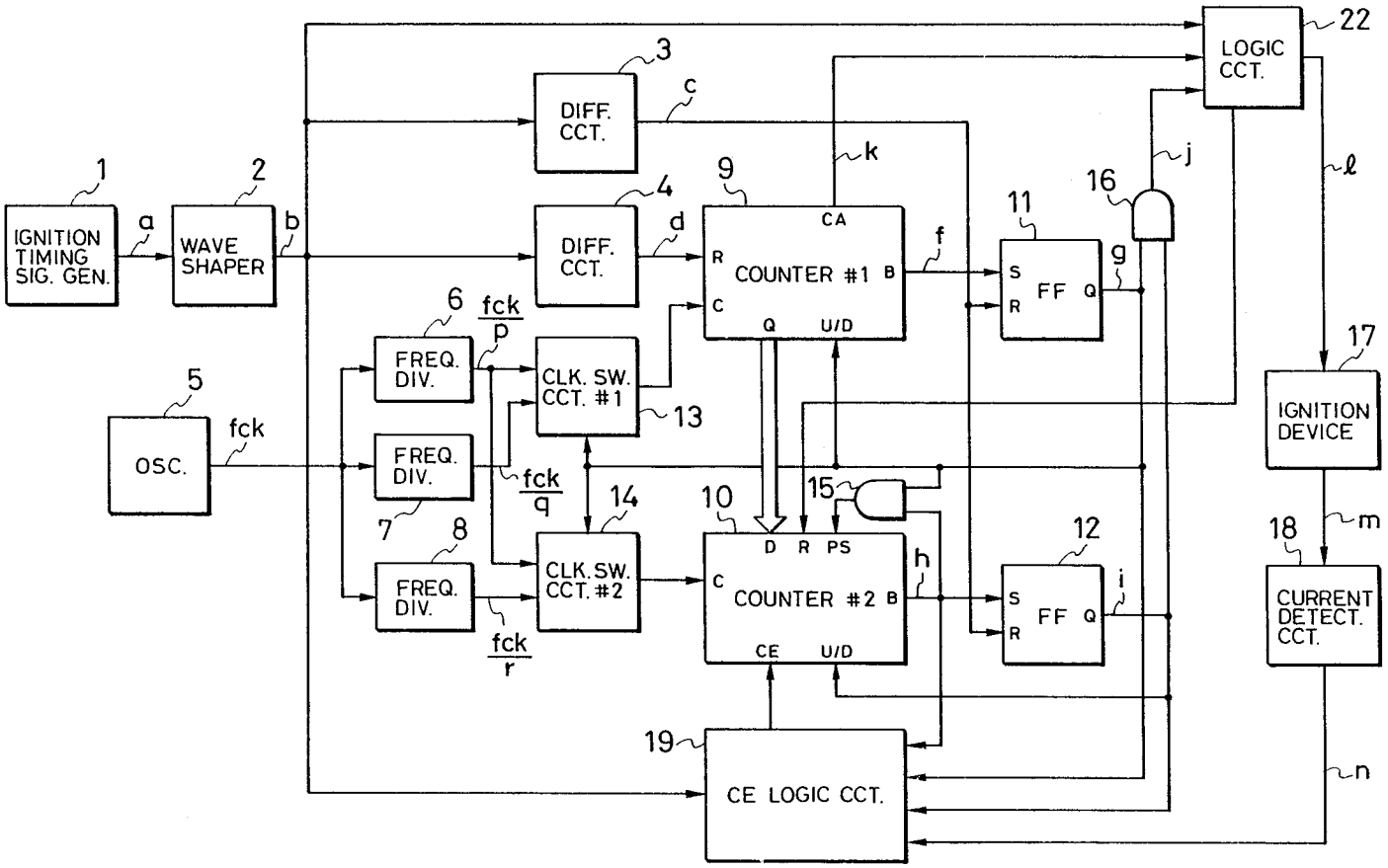
FIG. 5 is a block circuit diagram showing another embodiment of the present invention.
Figure 6:
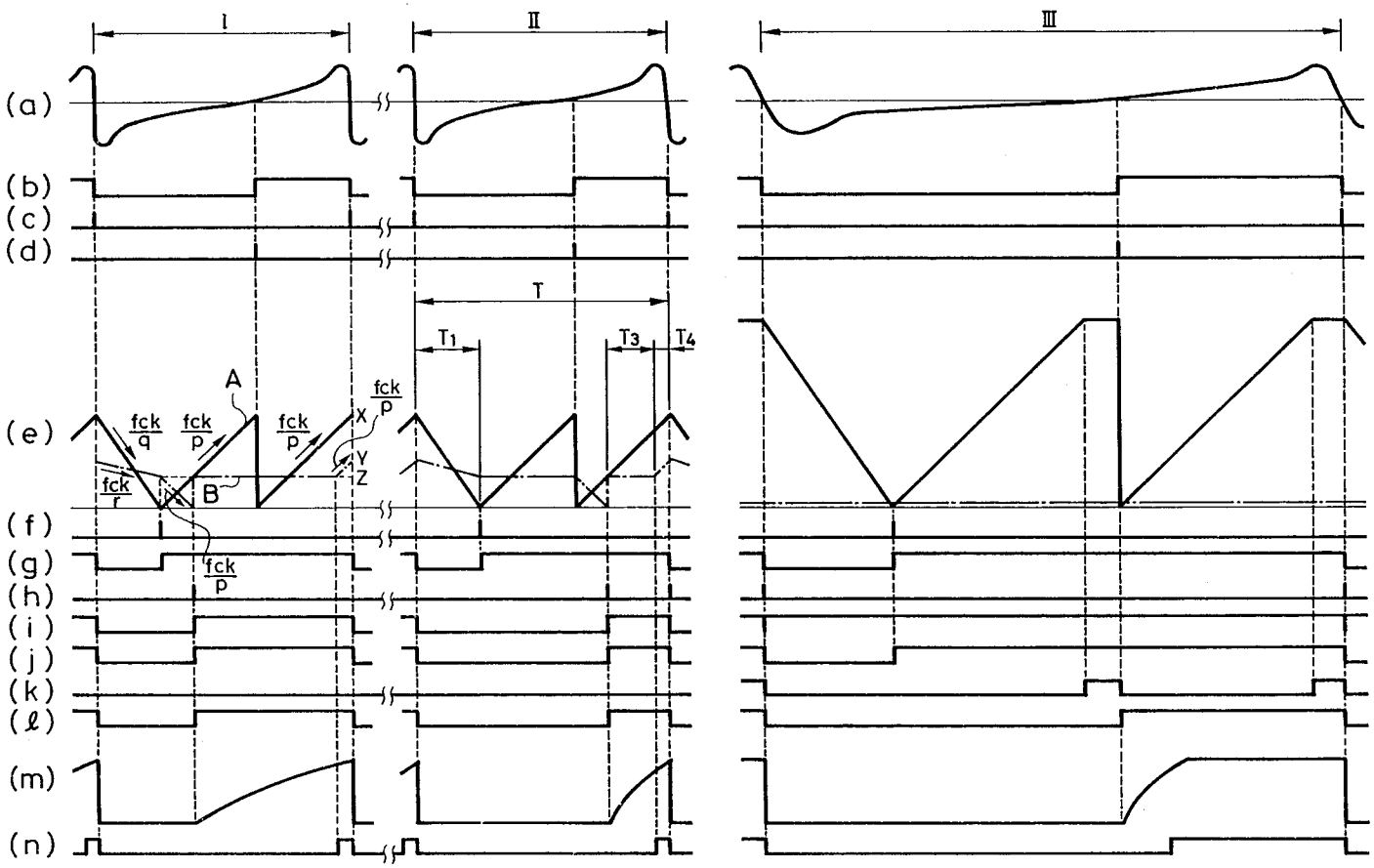
FIG. 6 shows waveforms for explanations of various portions of the control device shown in FIG. 5.

FIGS. 5 and 6 show another embodiment of the present invention.

In a case where the ignition period is extremely long when, for example, the engine is being started, a count content of a first counter 9 reaches an upper limit as shown in the period III in FIG. 6. Therefore, such operation of the current supply time as mentioned hereinbefore becomes impossible and thus the current supply time tends to be elongated too much, resulting in overheating of the ignition coil and/or the ignition device.

In the third embodiment of the present invention shown in FIG. 5, a logic circuit 22 determines the current supply time when the first counter 9 fully counts. Table 3 shows a logical operation of the logic circuit 22.

TABLE 3

| Input output signal at CA terminal of first counter 9 | Output: output to ignition device 17 in next ignition period | Output: output to R terminal of second counter 10 in next ignition period |
|---|---|---|
| L | output signal of AND gate 16 | L |
| H | output signal of waveshaper 2 | H |

In a case where the output at the CA terminal of the first counter 9 is "L", i.e., when the count in the first counter 9 is below the upper limit as shown in the periods I and II in FIG. 6, the output signal to the ignition device 17 in the next ignition period corresponds to the output of the AND gate 16, the output being shown by a waveform j in FIG. 6, and an output to the R terminal of the second counter 10 in the next ignition period is made "L".

In a case where the output at the CA terminal of the first counter 9 becomes "H" at least once during the ignition period, i.e., when the count in the first counter 9 reaches the upper limit as shown in the period III in FIG. 6, the output signal b of a waveshaper 2 is used as an output to the ignition device 17 in the next ignition period and a "H" output signal is provided at the R terminal of the second counter 10 in the next ignition period to thereby reset the latter counter.

Since, in this case, the maximum value of the current supply time of the ignition coil, i.e., the maximum circuit closing ratio, corresponds to the output signal g of the FF 11 and the "L" period of the output signal b is determined as being q/p with respect to the "H" period of the output signal of the waveshaper 2, it is possible to arbitrarily select the "H" period of the output signal of the waveshaper 2 with respect to the maximum circuit closing ratio by selecting the frequency dividing ratio, p or q. Therefore, by setting the maximum circuit closing ratio large and setting the circuit closing ratio during an extremely low revolution speed of the engine small, it is possible to retain the ignition energy required at a high revolution speed of the engine while minimizing heat generation at the starting time of the engine.

In the present invention, since the output signal of the ignition timing signal generator 1 is used after waveshaping, the current supply time obtained is stable even when the engine revolution fluctuates considerably as in the starting time thereof.

Although, in the embodiments described hereinbefore, digital circuits such as up/down counters, are used, it is possible to constitute them with analog circuits by, for example, substituting integration circuits for the up/down counters and substituting integration time constant switching circuit for the clock switching circuit, etc.

Further, although, in the described embodiments, the ignition timing signal generator provides such alternating signal as shown by the waveform a in FIG. 2, it is possible to use the ignition timing control device for determining the ignition timing of the engine with an aid of a microprocessor etc. as the ignition timing signal generator, in which case a rectangular signal provided by the ignition timing control device of the engine can be used as the rectangular wave b in FIG. 2.

What is claimed is:

1. An ignition control device for an internal combustion engine, comprising:

(a) first means (1, 2) for producing a signal synchronized with an ignition timing interval of the engine;

(b) second means (3, 4) responsive to said synchronized signal produced by said first means for producing a signal indicative of said ignition timing interval and a signal indicative of a time point at which an interval between successive ignition periods is divided into two sections with a predetermined ratio;

(c) third means (9) responsive to said ignition timing interval signal and said time point signal from said second means for producing a first signal within a period from a beginning of said ignition timing interval to said time point, and a second signal within a period from said time point to a beginning of a subsequent ignition timing interval;

(d) fourth means responsive to either of said first or second signals from said third means for establishing a start time of current supply to an ignition coil means, in dependence upon the establishment of a preceding current supply start time, to provide a current supply signal for said ignition coil means; and (e) switching means responsive to said current supply signal from said fourth means for on-off controlling a current to said ignition coil means.

2. The ignition control device as claimed in claim 1, wherein said fourth means responds to said first signal when the start time of current supply to said ignition coil means in a preceding ignition period is within a period from the beginning of said ignition timing interval to said time point and responds to said second signal when the start time of current supply to said ignition coil means in the preceding ignition period is within a period from said time point to the beginning of said subsequent ignition timing interval.

3. The ignition control device as claimed in claim 1, wherein said fourth means includes feedback means for controlling the ignition timing interval by feeding back a current flowing through said ignition coil means back.

4. The ignition control device as claimed in claim 1, wherein said fourth means responds to said first signal from said third means for setting a minimum required period of current supply to said ignition coil means.

5. The ignition control device as claimed in claim 4, wherein said minimum required period of current supply to said ignition coil means corresponds to a period from said time point to the beginning of said subsequent ignition timing interval.

6. The ignition control device as claimed in claim 1, wherein a current supply to said ignition coil means is performed in the period from said time point to the beginning of said subsequent ignition timing interval when the engine revolution is extremely low.

7. An ignition control device for internal combustion engine comprising an ignition timing signal generator for generating a signal in synchronism with an ignition timing of an engine, a first differentiator responsive to said output signal of said ignition timing signal generator for producing a signal indicative of an ignition timing, a second differentiator responsive to said output signal of said ignition timing signal generator for producing a time point signal at which an ignition period is divided into two sections with a predetermined ratio, at least a first, second and third signal generators for producing different frequency signals, a first and second clock switching circuits each for switching between two of said different frequency signals to provide one of said two frequency signals selectively, a first counter responsive to said output of said first differentiator for down-counting an output of said first clock switching circuit to provide an output when a content thereof becomes zero while setting itself to an up-count state and to provide an output indicative of an up-count content, a second counter responsive to said output of said first differentiator for down-counting said output of said second clock switching circuit to provide an output when the count thereof becomes zero and to hold a count content of said first counter at a time when said second counter provides said output, a first and second flip-flop adapted to be reset by said output of said first differentiator and to provide outputs by said outputs of said first and second counters, respectively, an ignition device responsive to said outputs of said flip-flops to supply a current to an ignition coil means, a current detection circuit for providing an output only when said current supplied to said ignition coil means exceeds a predetermined value and a count enable logic circuit responsive to said outputs of said ignition timing signal generator, said first and second flip-flops, said current detection circuit and said second counter for instructing said second counter a counting operation.

8. The ignition control device as claimed in claim 7, further comprising a logic circuit for operating said output signal derived from said ignition timing signal generator and said output signal of said second counter to produce an output signal, said current supply to said ignition coil means being performed according to said output signals of said first and second counters and said logic circuit.

* * * * *